US010928113B1

(12) United States Patent
Altshuler et al.

(10) Patent No.: US 10,928,113 B1
(45) Date of Patent: Feb. 23, 2021

(54) APPARATUS FOR GENERATING HYDROGEN-RICH ICE

(71) Applicants: Boris Altshuler, Miami, FL (US); Alexander Altshuler, Baltimore, MD (US)

(72) Inventors: Boris Altshuler, Miami, FL (US); Alexander Altshuler, Baltimore, MD (US)

( * ) Notice: Subject to any disclaimer, the term of this patent is extended or adjusted under 35 U.S.C. 154(b) by 0 days.

(21) Appl. No.: 17/095,203

(22) Filed: Nov. 11, 2020

Related U.S. Application Data

(62) Division of application No. 16/840,522, filed on Apr. 6, 2020, now Pat. No. 10,845,110.

(60) Provisional application No. 62/933,696, filed on Nov. 11, 2019.

(51) Int. Cl.
*F25C 1/00* (2006.01)

(52) U.S. Cl.
CPC ..... *F25C 1/00* (2013.01); *F25C 2300/00* (2013.01)

(58) Field of Classification Search
CPC ..... F25C 1/18; F25C 2300/00; F25C 1/06; F25C 1/25; A23G 9/325
See application file for complete search history.

(56) References Cited

U.S. PATENT DOCUMENTS 4,378,680 A * 4/1983 Garland ..... F25C 5/10 62/278
5,005,364 A * 4/1991 Nelson ..... F25C 5/00 62/76
6,334,328 B1 * 1/2002 Brill ..... A23G 9/045 62/347
6,508,075 B1 * 1/2003 Shipley ..... F25C 1/06 62/347
7,127,900 B2 * 10/2006 Yoshimura ..... F25C 1/18 62/69
7,371,907 B2 5/2008 Lokshin et al.
2005/0121399 A1 6/2005 Hayashi et al.
(Continued)

FOREIGN PATENT DOCUMENTS

JP 2014016088 A 6/2017

OTHER PUBLICATIONS

1. M. Lemaier et al., "Hydrogen: Therapeutic potential in wellness and medicine." Journal of Aging Research & Clinical Practice, vol. 6, 2017, p. 14.

(Continued)

*Primary Examiner* — Cassey D Bauer
(74) *Attorney, Agent, or Firm* — Nancy J. Flint, Attorney At Law, P.A.; Nancy J. Flint, Esq.

(57) ABSTRACT

A system and method for generation of hydrogen-rich ice (HRI) by introducing water that has been mixed with $H_2$ and $CO_2$ into the vertical tubes of a tube-ice machine is disclosed. The temperature and pressure within the vertical tubes can be maintained by refrigerant surrounding the vertical tubes to form carbon dioxide clathrate hydrates which entrap hydrogen molecules. The carbon dioxide clathrate hydrates cages with entrapped $H_2$ are encased, transported and then delivered after HRI discharge Later, when the HRI tube-ice is formed and released from tube-ice machine, it warms whereupon the carbon dioxide clathrate hydrates dissociate and the $H_2$ is released and used, for example by placement of the tube-ice small cylinders in a glass of water.

6 Claims, 3 Drawing Sheets

(56) References Cited

U.S. PATENT DOCUMENTS

| | | | | |
|---|---|---|---|---|
| 2010/0055029 | A1 | 3/2010 | Ahn | |
| 2010/0114546 | A1 | 5/2010 | Boyden et al. | |
| 2010/0114592 | A1 | 5/2010 | Boyden et al. | |
| 2011/0240753 | A1 | 10/2011 | Stevenson | |
| 2013/0043124 | A1 | 2/2013 | Park et al. | |
| 2014/0200511 | A1 | 7/2014 | Boyden et al. | |
| 2020/0025426 | A1* | 1/2020 | Wilkins | F25C 1/12 |

OTHER PUBLICATIONS

Ikuko Kimura, et al., "Molecular hydrogen as a preventive and therapeutic medical gas: initiation, development and potential of hydrogen medicine". Pharmacology & Therapeutics, vol. 144, issue I, Oct. 2014, pp. 1-11.

Kei Mizno, et al., "Hydrogen rich water for improvements of mood, anxiety and autonomic nerve function in daily life." Med. Gas Res. Oct.-Dec. 7, 2017(4), 245-255, Published online Jan. 22, 2018.

Ohsawa et al., "Hydrogen acts as therapeutic antioxidant by selectively reducing cytotoxic oxygen radicals". Nat. Med., 2007, 13, pp. 688-694.

Shigeo Ohta, et al., "Resent Progress Toward Hydrogen Medicine. Potential of Molecular Hydrogen for Preventive and Therapeutic Applications". Bentham Science Publishers Curr. Pharm. Des. Jul. 1, 2011, 77(22) pp. 2241-2252.

Ki-Mun Kang, et al., "Effect of drinking hydrogen rich water on the quality of life of patient treated with radiotherapy for liver tumors", Medical Gas Research., Jun. 7, 2011, 1, pp. 1-8.

Mark Sircus, E-book, Hydrogen Medicine, published Jan. 2018.

G. W. C. Kaye et al., Tables of Physical and Chemical Constants 15th ed., Longman, NY, 1986, p. 219.

S. S. Randhava, et al., "The hydrogenation of carbon dioxide in parts-per-million levels", Institute of Gas Technology, vol. 14-3 Jan. 2018, p. I-7 (PDF678418282017).

R.H. Perry's Chemical Engineers' Handbook Sixth Edition, McGraw Hill 1973, p. 3-102.

Brittany Glatz, et al., "Heterogonous Ice Nucleation, Interplay of Surface Properties and their Impact on Water Orientations," Langmuir, 2018, 34 (3), Clemson University, p. 1190-1198.

L. Rajnish, et al., "Gas hydrate formation from hydrogen/carbon dioxide gas mixtures" Chemical Engineering Science, vol. 62, issue Aug. 16, 2007, p. 4268-4276.

T. Habteyes et al., "Photodissociation of CO2 in water clusters." The Journal of Chemical Physics 126, 154301, 2007.

D.J. Milton et al., Carbon Dioxide Hydrate and Floods on Mars.

F. Isquierdo-Ruiz et al. Effect of CO2 Guest Molecule on the sl Clathrate Hydrate Structure Multidisciplinary Digital Publishing Institute (MDPI)m Sep. 15, 2016 DOI: 10.33901/ma 9090777.

VOGT P-24A & P34A Tube Ice Machine, Service Manual May 31, 2011.

S. Circone et al., "CO2 Hydrate: Synthesis, Composition, and Structure", J. Phys. Chem. B. vol. 107, issue 23, 2003, p. 5529-5539.

K.A. Lokshin et al., "Storing Hydrogen in Crystalline Molecular Cages of Water", Los Alamos Science, No. 30, 2006. Phys. Rev. Lett, 93, p. 125503-3, 2004.

W.P. Payne, Purdue University e-Pub International Refrigeration and Air Conditioning Conference School of Mechanical Engineering, 2002.

Duo Sun et al., Preservation of Carbon Dioxide Clathrate Hydrate at Temperature below the water Freezing Point under Atmospheric Pressure.

H.D.Nigashima. Preservation of Carbon Dioxide Clathrate Hydrate in the presence of Trehalose under Freezer Conditions, Scientific Reports, v.6. 2016, 19354.

A.A. Chemov et al., "New Hydrate formation Methods in liquid gas medium." Sci Rep. 2017, 7, 40809. Published online Jan. 18, 2017, doi:10.1038/step 40809.

M. Hirscher, Clathrate Hydrates Chapter 3. Handbook of Hydrogen Storage, p. 63-70, Willey 2010.

G. Roman-Perez et al, "Stability, Adsorption and Diffusion of CH4, CO2 and H2 in Clathrate Hydrates." Cornell University, Material Science (cond-mat.mtri-sci) DOi. 10.1103/Phys.Letter. 105.145901.

* cited by examiner

APPARATUS FOR GENERATING HYDROGEN-RICH ICE

FIELD OF THE INVENTION

The invention relates generally to hydrogen therapy and specifically to methods for generating hydrogen-rich ice.

BACKGROUND OF THE INVENTION

Molecular hydrogen is the smallest gas molecule that can cross cellular membranes and diffuse throughout the body; As a result, hydrogen can be considered as safe and inert within the human body [1]. The reaction constants of hydrogen with oxide radical ion ($O^-$) and hydroxyl radical ($OH^-$) in water is in the order of $10^{-7}$ M/s, compared to other molecules that are in the orders of $10^{-9}$ to $10^{-10}$ M/s. Classically, conventional antioxidant therapy was limited because it neutralized both the detrimental and protective effects of reactive oxygen species ("ROS"): strongly oxidizing ROS, e.g., $OH^-$, which damage tissue and advantageous species, superoxide and hydrogen peroxide, which enhance endogenous protective signal transduction pathways. As a typical reducing agent, hydrogen gas avoids this paradox by rapid reacting with strong oxidants, e.g., $OH^-$, while leaving other beneficial oxidants reactive.

Molecular hydrogen ($H_2$) has been accepted to be an inert and nonfunctional molecule in our body. However, the validity of this concept is currently called in to question as recent studies demonstrate that $H_2$ reacts with strong oxidants, such as hydroxyl radical in cells, and propose its potential for preventive and therapeutic applications. $H_2$ has a number of advantages exhibiting extensive effects. For example, $H_2$ rapidly diffuses into tissues and cells. $H_2$ is mild enough to neither disturb metabolic redox reactions nor affect signaling reactive oxygen species. Therefore, there should be no adverse health effects of ingesting $H_2$.

The publications on the biological and medical benefits of $H_2$ reveal that $H_2$ reduces oxidative stress not only by direct reactions with strong oxidants, but also indirectly by regulating various gene expressions. In this manner, $H_2$ functions as an anti-inflammatory and anti-apoptotic as well as stimulates energy metabolism. In addition to growing evidence obtained by model animal experiments, there are clinical examinations currently under investigation. Since most drugs specifically act to their targets, $H_2$ seems to differ from conventional pharmaceutical drugs. Owing to its great efficacy and lack of adverse effects, $H_2$ has promising potential for clinical use against many diseases [1]. For example, chronic oxidative stress and inflammation cause deteriorations in central nervous system functionality, leading to low quality of life ("QOL").

$H_2$ has antioxidant activity, prevents inflammation, and may contribute to improve QOL. One study aimed to investigate the effects of drinking hydrogen-rich water ("HRW") on the QOL of adult volunteers using psychophysiological tests, including questionnaires and tests of autonomic nerve function and cognitive function [2]. Persistent oxidative stress is one of the major causes of most lifestyle-related diseases, some cancers, and the aging process.

Acute oxidative stress can damage biological tissues. Despite the clinical importance of oxidative damage, antioxidants have been of limited therapeutic success. It was proposed that $H_2$ has potential as a "novel" antioxidant in preventive and therapeutic applications. Hydrogen has a number of advantages as a potential antioxidant: $H_2$ rapidly diffuses into tissues and cells; and it is mild enough to neither disturb metabolic redox reactions nor affect reactive oxygen species ("ROS") that function in cell signaling. As such, consuming $H_2$ has no adverse effects [3].

There are several methods known in the art to ingest or consume $H_2$ that include, but are not limited to, inhaling hydrogen gas, drinking $H_2$-dissolved water (hydrogen-rich water, or HRW), taking a hydrogen bath, injecting $H_2$-dissolved saline (hydrogen saline), and dropping hydrogen saline onto the eye [1]. Since the publication of the first $H_2$ paper in Nature Medicine in 2007, the biological effects of $H_2$ have been confirmed by the publication of more than 38 diseases, physiological states and clinical tests in leading biological/medical journals, and several groups have started clinical examinations. Moreover, $H_2$ also demonstrates various anti-inflammatory and anti-allergic effects. For example, $H_2$ regulates various gene expression and protein-phosphorylation events, though the molecular mechanisms underlying the marked effects of very small amounts of $H_2$ remain elusive [4].

The solubility concentration of $H_2$ in conventional water (e.g. tap, bottled, filtered, etc.) is about 8.65×10−7 mg/L. In other words, a liter of water can hold less than one eight-millionth of a mg of $H_2$, which is already a therapeutic value. Studies using hydrogen gas dissolved in water range from 0.5 mg/L to 1.6+mg/L, with most studies using a concentration near 1.6 mg/L (0.8 mM). According to the current state of the art, the concentration at "saturation" of $H_2$ in water under ambient conditions (293° K and 0.1 MPa) is 1.6 mg/L (1.6 ppm or 0.8 mM) [5].

$H_2$ can be dissolved in water up to 1.6 ppm under atmospheric pressure at room temperature as mentioned earlier. Unexpectedly, drinking hydrogen-rich water ("HRW") had effects comparable to hydrogen gas inhalation.

HRW can be made by several methods, including dissolving hydrogen gas in water under high pressure in water as well as by reacting magnesium with water. HRW can be generated by electrolyzing water to produce hydrogen gas and dissolving the hydrogen gas in the water to produce high concentration hydrogen-rich water [6].

Drinking liquid supplemented with hydrogen represents a novel method of hydrogen gas delivery that is easily translatable into clinical practice with beneficial effects for several medical conditions, including atherosclerosis, type 2 diabetes, metabolic syndrome, and cognitive impairment during aging and in Parkinson's disease [1]. Currently, there are no definitive therapies that address the quality of life ("QOL") of patients receiving radiotherapy. Daily consumption of soluble hydrogen may be therapeutically beneficial and could use known methods of administration to reduce its impact on the patient's lifestyle. Unfortunately, ingesting hydrogen-rich water, generated via a magnesium stick, produces adverse events in patients receiving radiotherapy [5].

The consumption of hydrogen-rich water for six (6) weeks reduced reactive oxygen metabolites in the blood and maintained blood oxidation potential. QOL scores during radiotherapy were significantly improved [5].

Consuming hydrogen-rich water flushes the human body with trillions of $H_2$ molecules. For example, hydrogen is an effective molecule that can scavenge or pair up with toxic hydroxyl radicals in the body and thereby neutralize the toxic molecules. Hydrogen therapy is safe as $H_2$ has no upper limit of use. The therapeutic effects of $H_2$ consumption increase as the amount consumed increases. For example, hydrogen therapy can theoretically improve the condition of patients suffering from late stage cancer.

Hydrogen gas has no toxicity because the byproduct of the free-radical neutralizing reaction is water. Each molecule of $H_2$ neutralizes 2 hydroxyl radicals into two molecules of $H_2O$ and thereby hydrates cells in the process. HRW having a concentration of 1.6 mg/L (or 1.6 ppm) includes more "antioxidant" molecules than 100 mg of vitamin C, because 1.6 mg of hydrogen includes more total molecules compared 100 mg of vitamin C [7].

Solubility of gases in water is affected by pressure and temperature. For example, increasing the pressure increases the solubility of $H_2$ gas in water and decreasing the temperature increases $H_2$ gas solubility in water. As $H_2$ is a non-polar molecule, it does not readily form hydrogen bonds with water molecules, which results in a favorable solubility in water. For example, the solubility of hydrogen in water is comparable to the solubility of nitrogen or oxygen gas, which are both non-polar. On the other hand, polar gasses, such as $CO_2$, exhibit solubility values that are 100 times greater than that of hydrogen [8].

On the other part, hydrogen and carbon dioxide have covalent bonds that are compatible with each other and under certain conditions the following reaction takes place:

$$CO_2+4H_2=CH_4+2H_2O$$

Of course, this $CO_2$ metanization reaction under ambient conditions is negligible, but the theoretical probability of this reaction allows one to estimate the optimum gas composition of a hydrogen and carbon dioxide mixture. Here, $CO_2$ methanization occurs by first associatively adsorbing a hydrogen atom and forming oxygen intermediates before hydrogenation or dissociating and forming a carbonyl before being hydrogenated [9]. Thus, $CO_2$ methanization requires the use of 80 vol. % of $H_2$ and 20 vol. % of $CO_2$ gas mixture in the instant method.

Since decreasing the temperature increases gas solubility in water, the hydrogen and carbon dioxide gas mixture should be dissolved in water under minimum acceptable water temperature up to freezing conditions (i.e. less than 273° K). In fact, the solubility of hydrogen below 273° K is about 2.0 mg/L $H_2O$ (2.0 ppm), but below 293° K is 1.6 mg/L $H_2O$ (1.6 ppm) and under 298° K is—1.5 mg/L $H_2O$ (1.5 ppm) [10]. As such, dissolving and preserving the maximum amount of hydrogen in water requires that the temperature of the solution should be minimized.

The best method to capture dissolved hydrogen in water is to freeze HRW [11]. According to Reference [11], hydrogen is generated by the chemical reaction of magnesium salt with warm water (e.g., under 298° K) and then the water solution is frozen to thereby yield hydrogen saturated ice. A disadvantage of this method is the usage of an additional complicated step in a hydrogen saturated ice production. Here, warm water is used to increase the rate of magnesium chemical reaction, which was used for hydrogen production. Moreover, subsequent exposure to the frozen water cannot increase the ice hydrogen concentration, because, according to the reference, hydrogen was initially absorbed under high temperature.

According to the current state of the art, nucleation initiates the formation of ice crystals. Nucleation is a process where the molecules in a liquid start to gather into tiny clusters, arranging in a way that will define the crystal structure of a solid. There are two types of nucleation processes. Ice is ubiquitous in nature, and heterogeneous ice nucleation is the most common pathway of ice formation. Heterogeneous nucleation occurs when ice begins to form around a nucleation site, such as a physical disturbance, impurity (e.g., salt) in the liquid, or an irregularity in the container holding the solution. Biological samples, for example, do not consist of pure water, the samples always experience heterogeneous nucleation. [12].

Clathrate hydrates are inclusion compounds in which "guest" molecules occupy the "cages" formed in a hydrogen-bonded water network. Solid gas clathrate hydrates generally form at high pressure and low temperatures near or even above the ice point. One of the unique properties of gas hydrate is the ability to trap 70 to 300 gas volumes for one water volume [25]. A hydrogen clathrate hydrate is a clathrate containing hydrogen in a water lattice. Pure hydrogen can form water hydrate itself as well at very low temperature around 4° K and high pressure of around 700 MPa [20]. This substance is interesting due to its possible use to store hydrogen in a hydrogen industry [27]. The storage of hydrogen gas in clathrate hydrate at ambient conditions has many potential applications such as clean energy, environment and ecology protection [20][25][26]. The stability of hydrate depends on the particle size, the initial hydrate mass fractions and the preservation temperatures.

$CO_2$ clathrate hydrates are formed using a $CO_2/H_2$ mixture, and hydrogen is "trapped" within the $CO_2$ clathrate hydrate as well. Better stability has been observed for $CO_2$ hydrate crystal samples of larger particle size and preserved at lower temperature [22],[23]. Samples having particles size of 1.0 mm and 5.6-8.0 mm have been reported to be stored at 243.2° K and 253.2° K. for three weeks under atmospheric pressure [22].

At around 0.1 MPa and temperatures of around 274-283° K carbon dioxide clathrate hydrates dissociate [16] and entrapped hydrogen is released. The products of the dissociation are water and the entrapped "guest" gas molecules. But under temperature below the water freezing point (freezer conditions) the carbon dioxide clathrate hydrates can be store more than three weeks [21], [20].

Tube-ice is a cylindrical form of ice that has an inner hole. Tube-ice is made using a tube-ice machine that has an ice generator, which is a vertical shell-and-tube vessel surrounded by coolant (or refrigerant). Tube-ice is formed as ice columns on the inner surfaces of vertical tubes and are produced in the form of small hollow cylinders. The tube-ice machine arrangement has a similar design to a shell and tube heat exchanger with the water on the inside of the tubes and coolant, or refrigerant, filling the space between the vertical tubes. The machine is typically operated automatically on a time cycle and the columns of ice that form on the inner surface of the vertical tubes are released by a hot gas defrost process. As the ice columns drop from the tubes a cutter chops the ice into suitable lengths.

In operation, low temperature refrigerant liquid is filled into the space between the vertical tubes. Water is pumped from a tank and delivered to the inlets of the vertical tubes whereupon the water flows downwardly along the inner walls of vertical tubes. The water in the interior of the vertical tubes exchanges heat with the low temperature refrigerant surrounding the vertical tubes whereupon the water freezes to form ice films in the interior surfaces of the vertical tubes. As the water is recirculated through the vertical tubes during the freezing cycle, the ice films increase in size until the ice films reach a certain thickness to, whereupon hot refrigerant gas displaces the low temperature refrigerant gas and melts the surface of the ice films. Columns of ice release from the vertical tubes because of gravitational force and fall into an ice cutter, whereupon they are cut into pieces of tube-ice.

BRIEF SUMMARY OF THE INVENTION

Hydrogen-rich ice can be generated by introducing water that has been mixed with $H_2$ and $CO_2$ into the vertical tubes of a tube-ice machine. The temperature and pressure within the vertical tubes can be maintained by refrigerant surrounding the vertical tubes to form carbon dioxide clathrate hydrates which entrap hydrogen molecules, and thereafter transport and deliver an entrapped hydrogen under conditions where the carbon dioxide clathrate (or carbon dioxide clathrate hydrate cages) exists. As the water/hydrogen/carbon dioxide mixture cools, carbon dioxide clathrate hydrates cages are formed in which $H_2$ gas is entrapped. The carbon dioxide clathrate hydrates cages with entrapped $H_2$ are encased within the sheets of ice formed in the vertical tubes of the tube-ice machine. Later, when the HRI tube-ice is used, it warms whereupon the carbon dioxide clathrate hydrates dissociate and the $H_2$ is released and used, for example by placement of the tube-ice small cylinders in a glass of water.

BRIEF DESCRIPTION OF THE DRAWINGS

The invention will be more readily understood from the following detailed description of the various aspects of the invention taken in conjunction with the accompanying drawings in which.

DETAILED DESCRIPTION OF THE INVENTION

Figure 1:
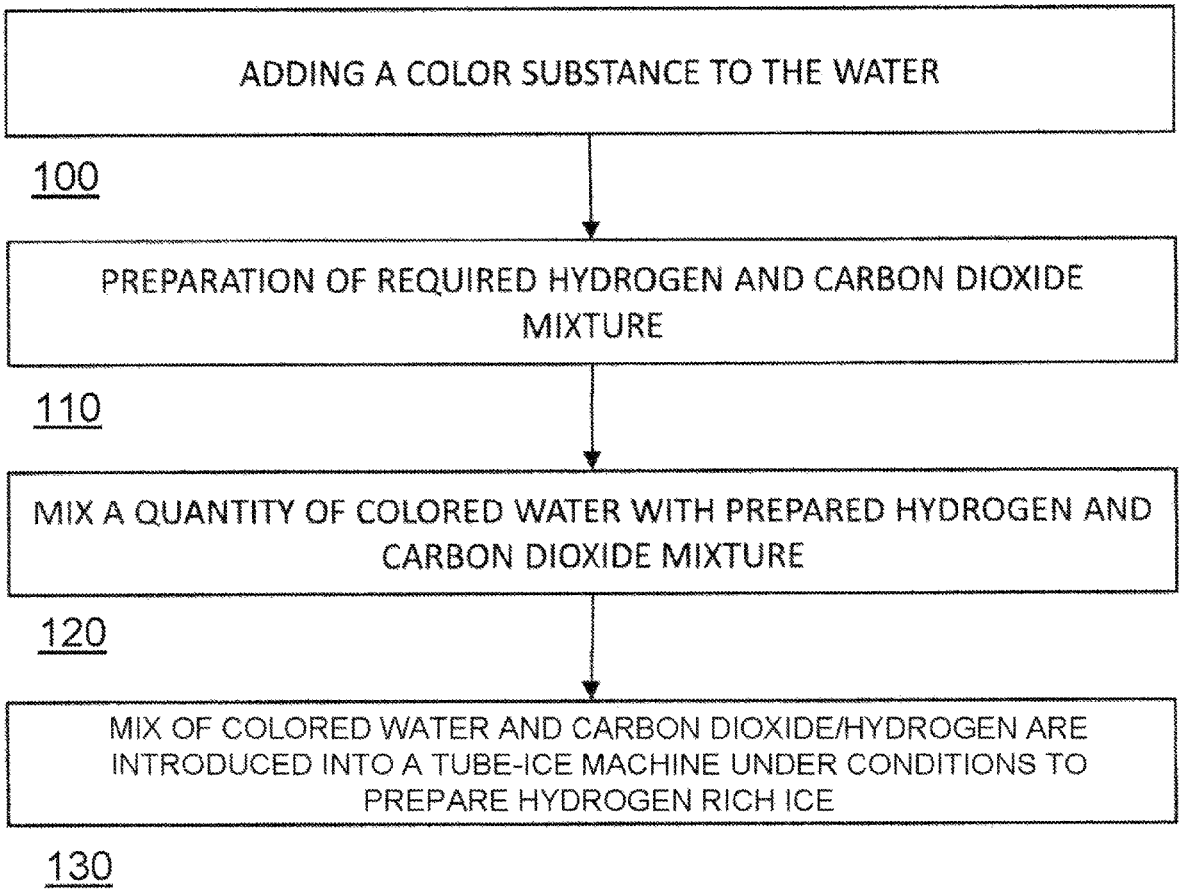
FIG. 1 depicts a flow diagram of a method for generating hydrogen-rich ice according to one embodiment of the invention.

The invention relates to a method for generating hydrogen-rich ice using a tube-ice machine. In one embodiment, the invention relates to the use of a tube-ice machine that produces ice automatically in vertical tubes, momentarily thaws ice from the tubes, and then cuts the ice tubes into short cylinders [16]. Holes are formed during ice formation as a result of a falling film of water freezing inside the vertical tube of the tube-ice machine.

Under tube-ice machine conditions theory, pressures of around 200 MPa can result when water is cooled without allowing it to expand. Therefore, when water freezes in a pipe, it expands and can exert pressure that can rupture the pipe as the water has no place to expand as it freezes. To ensure correct operation of the method disclosed herein, a hole in the center of the vertical tubes of about 6 mm diameter is maintained.

A mixture of hydrogen and carbon dioxide gas is mixed with water prior to introduction into the vertical tubes of the tube-ice machine. Dissolved $CO_2$ provides the nucleation of water molecules via heterogeneous nucleation to form carbon dioxide clathrate hydrates [13]. Carbon dioxide clathrate hydrates are solid shaped particles comparable to ice that are formed when carbon dioxide and water combine at low temperature or high pressure. Carbon dioxide clathrate hydrates are complexes typically having 2-40 water molecules approximately [15]. For a tube-ice machine that has capacity of 1.0 gpm water inlet (about 5 ton/day of ice), the inlet water of 1.0 gpm would be mixed with approximately 8 scfm of $CO_2$ and 32 scfm of $H_2$.

Experimental data on the kinetics of carbon dioxide clathrate hydrate formation and its solubility in distilled water are reported. The reported experiments were carried at nominal temperatures of 274°, 276° and 278° K (5° C.) and at pressure ranging from 1.59 to 2.79 MPa [12]. The rate of hydrate growth from mixtures of $CO_2/H_2$ gas was found to be faster [13] than a reaction with a $CO_2/N_2$ mixture [14].

Regular ice texture suggests that original intergranular seed ice porosity persists during carbon dioxide clathrate hydrate synthesis, which pores are about 120 μm [15] or about 10 times smaller than formed carbon dioxide clathrate hydrate pores.

Temperature and pressure conditions within the vertical tubes of a tube-ice machine can be conducive to carbon dioxide clathrate hydrate cluster creation. A tube-ice machine can be designed to realize temperatures within the vertical tubes of between 240° K (using anhydrous ammonia refrigerant) and 232° K (using R22 refrigerant) [17]. Carbon dioxide clathrate hydrate clusters can be formed at these temperatures at atmospheric pressure as well.

One volume of carbon dioxide clathrate hydrate (cluster) has a size about 150-212 cubic Angstroms [15] and may entrap (or "cage") theoretically up to about 250 hydrogen molecules. Introduction of a gas mixture of hydrogen and carbon dioxide into the vertical tubes of a tube-ice machine at certain temperatures thus may provide for the creation of empty carbon dioxide clathrate hydrate cages that allows for transport of hydrogen gas into the interior carbon dioxide clathrate hydrates [19].

The tube-ice machines suitable for use in the invention are operated such that the pressure in the interior of the vertical tubes where ice with $CO_2$ clathrate hydrates are formed is close to atmospheric pressure such that the formation of HRI will depend on the freezing temperature only which is equal to the refrigerant boiling point (for anhydrous ammonia—240° K or for refrigerant R22—232° K [21]). In one embodiment, the central holes are around 6 mm in diameter [18]. Accordingly, conditions within the vertical tubes of the tube-ice machine for HRI formation can be achieved using existing temperature control equipment. In the tube-ice machine suitable for use in the invention, the vertical tubes are designed as typical tube shell heat exchangers and there will not be a significant temperature gradient between the inlet and the outlet of the vertical tubes. Refrigerant is pumped such that it surrounds the vertical tubes.

In one embodiment, $H_2$ and $CO_2$ can be mixed with the water prior to introduction into the inlet of the vertical tubes using gas ejectors or liquid power eductors. Ejectors are used in the industry in numerous unique ways. They can be used singly or in stages to create a wide range of vacuum conditions, or they can be operated for mass transfer and mixing operations. Eductors are a simple type of pump which work on the 'venturi effect' to pump out gas or liquid [19]. Eductors require only a motive fluid or driving fluid for operation, which allows for the effective liquid and gas mixing. When the driving fluid is passed through the eductor at the required capacity (which depends on the design of the eductor), a low pressure is created inside it. This low pressure or vacuum enables the eductor to suck and mix gases (for example, here, $H_2$ and $CO_2$) and liquid (for example, water) from a certain area. Then this liquid mixed with gases can be pumped out to the vertical tubes of the tube-ice machine.

In one embodiment, the hydrogen-rich ice that is formed is colored to identify it as hydrogen-rich ice ("HRI"), for example "green." In this embodiment, a coloring agent can be mixed with the water prior to introduction of the water/$H_2/CO_2$ solution into the vertical tubes of the tube-ice machine. In one embodiment, water that has been previously colored can be mixed with the $H_2$ and $CO_2$.

Turning to the figures, FIG. 1 depicts a flow diagram of a method for generating hydrogen-rich ice according to one embodiment of the invention where the water is colored prior to freezing. At 100, a colored substance is added to water. At 110, a mixture of carbon dioxide and hydrogen is prepared. At 120, the colored water and carbon dioxide/hydrogen mixture are mixed. At 130, the mixed colored water and carbon dioxide/hydrogen are introduced into the vertical tubes of a tube-ice machine under conditions to prepare hydrogen rich ice.

Figure 2:
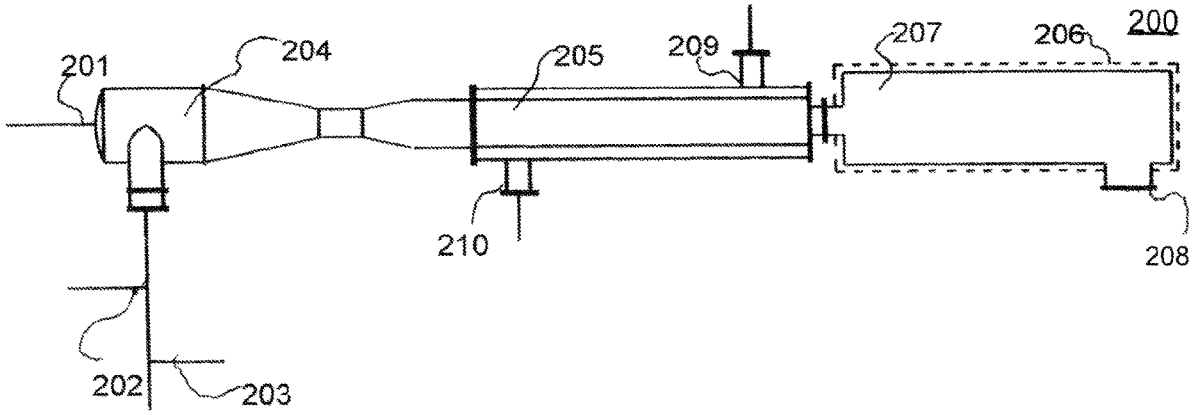
FIG. 2 depicts a liquid/gas mixer for use in a tube-ice machine according to one embodiment of the invention.

FIG. 2 depicts a schematic of a liquid/gas mixer 200 for use in a tube-ice machine according to one embodiment of the invention. A driving liquid 201 (such as water) can be introduced into the inlet of an eductor 204. Gases hydrogen and carbon dioxide are introduced into eductor 204 at hydrogen gas inlet 203 and carbon dioxide inlet 202. The water, hydrogen and carbon dioxide mix in the interior of eductor 204 and exit into horizontal tube 205. Horizontal tube 205 is designed as a tube in a tube heat exchanger and can be cooled for example by a blanket of cooling liquid that enters a cooling sleeve at coolant entrance 209 and exits the cooling sleeve at coolant exit 210. The water/hydrogen/carbon dioxide mixture can pass through cooled horizontal tube 205 and can exit horizontal tube 205 into collection tank 207, which can be insulated with an insulated sleeve 206 and connected with the top of a tube-ice machine. The cooled water/hydrogen/carbon dioxide solution can be held in collection tank 207 for introduction into the vertical tubes of a tube-ice machine using inlet 208.

Figure 3:
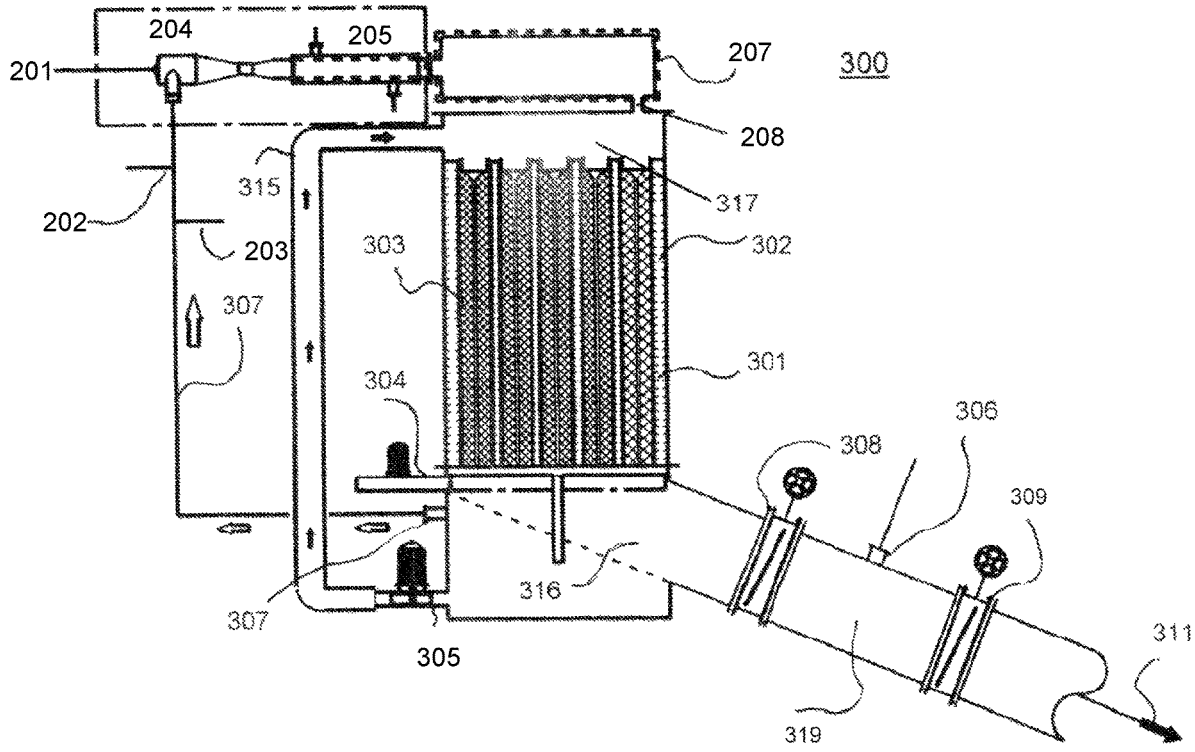
FIG. 3 depicts a tube-ice machine for use in the method according to one embodiment of the invention.

FIG. 3 depicts a tube-ice machine 300 for use in the method of producing hydrogen-rich ice according to one embodiment of the invention. On the top of the tube-ice machine 300 a liquid/gas mixer 200 as described in FIG. 2 can be installed comprising thermally insulated collection tank 207, eductor 204 and horizontal tube 205. The water/hydrogen/carbon dioxide mixture can pass out of collection tank 207 and into inlet 208 of a plurality of vertical tubes 301 which are cooled by a blanket 302 of refrigerant, or coolant agent, surrounding vertical tubes 301. During a freezing cycle, the water/hydrogen/carbon dioxide mixture is circulated by water pump 305 through recirculation pipe 315. As the water/hydrogen/carbon dioxide mixture passes through the vertical tubes 301, hydrogen saturated carbon dioxide clathrate hydrates are entrapped within ice 303 that forms on the interior walls of vertical tubes 301. After the completion of a freezing cycle ice 303 begins thawing which causes ice 303 to drop on a rotating cutter 304 for sizing [18]. Cut ice 303 enters into a collection tank 316 and then enters through an opened first guillotine damper 308 to chamber 319. During this process, excess hydrogen and carbon dioxide gas are suctioned through suction line 307 back to eductor 204. In this embodiment, special instrumentation and control (P&ID and PLC) should be used to monitor and control the hydrogen and carbon dioxide gas concentrations entering eductor 204.

Chamber 319 is an insulated lock chamber to prevent the release of hydrogen to the atmosphere. Chamber 319 is enclosed on either end with first guillotine damper 308 and second guillotine damper 309. While the design of chamber 319 in this embodiment is not part of the process of making HRI, it is a safety system support feature to minimize explosive hydrogen concentration. Once cut ice has entered chamber 319, first guillotine damper 308 and second guillotine damper 309 are closed and carbon dioxide enters through inlet port 306. Then HRI in the form of cut tube-ice is discharged from chamber 319 through exit 311 upon opening of second guillotine damper 309.

As noted, HRI formed as described above has hydrogen saturated carbon dioxide clathrate hydrates entrapped within it. Later, as the HRI is used, for example placed in a glass of water, the HRI begins to melt. This causes the hydrogen saturated carbon dioxide clathrate hydrates to dissociate and release the hydrogen, whereupon the hydrogen can be consumed.

The foregoing description of various embodiments of the invention has been presented for purposes of illustration and description. It is not intended to be exhaustive or to limit the invention to the precise form disclosed and, obviously, many modifications and variations are possible. Such modifications and variations that may be apparent to a person skilled in the art are intended to be included within the scope of the invention as defined by the accompanying claims.

REFERENCES

1. M. Lemaier et al., "Hydrogen: Therapeutic potential in wellness and medicine." *Journal of Aging Research & Clinical Practice*, vol. 6, 2017, p. 14.
2. Ikuko Kimura, et al., "Molecular hydrogen as a preventive and therapeutic medical gas: initiation, development and potential of hydrogen medicine". *Pharmacology & Therapeutics*, vol. 144, issue 1, October 2014, pages 1-11.
3. Kei Mizno, et al., "Hydrogen rich water for improvements of mood, anxiety and autonomic nerve function in daily life." *Med. Gas Res.* 2017, October-December, 7(4), 245-255, Published online Jan. 22, 2018.
4. Ohsawa et al., "Hydrogen acts as therapeutic antioxidant by selectively reducing cytotoxic oxygen radicals". *Nat. Med.,* 2007, 13, pages 688-694.
5. Shigeo Ohta, et al., "Resent Progress Toward Hydrogen Medicine. Potential of Molecular Hydrogen for Preventive and Therapeutic Applications". Bentham Science Publishers *Curr. Pharm. Des.* 2011, July, 1 77(22) pages 2241-2252.
6. Ki-Mun Kang, et al., "Effect of drinking hydrogen rich water on the quality of life of patient treated with radiotherapy for liver tumors", *Medical Gas Research.,* 2011 Jun. 7, 1, pages 1-8.
7. Inchol Park et al., "Portable Hydrogen-rich Water Generator". US Patent Publication No. 2013/0043124A1, pub. Feb. 21, 2013.
8. Mark Sircus, E-book, Hydrogen Medicine, published January 2018.
9. G. W. C. Kaye et al., Tables of Physical and Chemical Constants 15th ed., Longman, N Y, 1986, p. 219.
10. S. S. Randhava, et al., "The hydrogenation of carbon dioxide in parts-per-million levels", *Institute of Gas Technology*, vol 14-3 1-2018, p. 1-7 (PDF678418282017).
11. R. H. Perry's Chemical Engineers' Handbook Sixth Edition, McGraw Hill 1973, p. 3-102.
12. Jukio Hirose, "Active Hydrogen Containing Ice", JP2014016088A, 2017 Jun. 21.
13. Brittany Glatz, et al., "Heterogonous Ice Nucleation, Interplay of Surface Properties and their Impact on Water Orientations," Langmuir, 2018, 34 (3), Clemson University, p. 1190-1198.
14. L. Rajnish, et al., "Gas hydrate formation from hydrogen/carbon dioxide gas mixtures" *Chemical Engineering Science*, vol. 62, issue 16 Aug. 2007, p. 4268-4276.
15. T. Habteyes et al., "Photodissociation of $CO_2$ in water clusters." *The Journal of Chemical Physics* 126, 154301, 2007.
16. D. J. Milton et al., Carbon Dioxide Hydrate and Floods on Mars.

17. F. Isquierdo-Ruiz et al. Effect of CO2 Guest Molecule on the sI Clathrate Hydrate Structure Multidisciplinary Digital Publishing Institute (MDPI)m 2016 September 15, DOI: 10.33901/ma 9090777.
18. VOGT P-24A & P34A Tube Ice Machine, Service Manual May 31, 2011.
19. S. Circone et al., "$CO_2$ Hydrate: Synthesis, Composition, and Structure", *J. Phys. Chem. B*. Vol. 107, issue 23, 2003, page 5529-5539.
20. K. A. Lokshin et al., "Storing Hydrogen in Crystalline Molecular Cages of Water", Los Alamos Science, Number 30, 2006. Phys. Rev. Lett, 93, p. 125503-3, 2004.
21. W. P. Payne, Purdue University e-Pub International Refrigeration and Air Conditioning Conference School of Mechanical Engineering, 2002.
22. Duo Sun et al., Preservation of Carbon Dioxide Clathrate Hydrate at Temperature below the water Freezing Point under Atmospheric Pressure.
23. H. D. Nigashima. Preservation of Carbon Dioxide Clathrate Hydrate in the presence of Trehalose under Freezer Conditions, Scientific Reports, v.6. 2016, 19354.
24. G. L. Stevenson et al., Directed multi port eductor and method of use, U.S. Patent Appln. Publn. No. 20110240753A1, Oct. 6, 2011.
25. A. A. Chernov et al., "New Hydrate formation Methods in liquid gas medium." *Sci Rep.* 2017, 7, 40809. Published on line 2017, Jan. 18, doi:10.1038/step 40809.
26. M. Hercher, Clathrate Hydrates Chapter 3. Handbook of Hydrogen Storage, p. 63-70, Willey 2010.
27. G. Roman-Perez et al Stability, "Adsorption and Diffusion of CH4m CO2 and H2 in Clathrate Hydrates." Cornell University, Material Science (cond-mat.mtri-sci) DOi. 10.1103/Phys. Letter. 105.145901.

What is claimed is:

1. A system for generating hydrogen-rich ice (HRI) comprising:

an eductor;
a hydrogen gas inlet line;
a carbon dioxide gas inlet line;
a water inlet line;
a heat exchanger;
a thermal-insulated first container;
a plurality of vertical tubes;
a coolant container;
an insulated blanket surrounding the plurality of vertical tubes;
a recycling pump;
a first recycling line;
an ice cutter;
an isolating lock chamber with carbon dioxide overpressure;
a first guillotine damper and a second guillotine damper; and
an inlet port to the isolating lock chamber with carbon dioxide overpressure,
wherein water is introduced into an interior chamber of the eductor, wherein the water comprises a motive fluid causing hydrogen gas and carbon dioxide gas to be drawn and mixed into the interior chamber of the eductor,
wherein the water, hydrogen gas and carbon dioxide gas are mixed in the interior chamber of the eductor and thereafter are introduced into an interior chamber of the thermal-insulated first container, wherein the thermal-insulated first container is heated by heat provided by the heat exchanger
wherein the mixture of water, hydrogen gas and carbon dioxide gas is thereafter introduced into each of an interior of the plurality of vertical tubes,
wherein the plurality of vertical tubes is disposed within an interior of the coolant container, wherein the coolant container comprises a coolant agent,
wherein the mixture of water, hydrogen gas and carbon dioxide gas is circulated by the recycling pump multiple times through the interior of the vertical tubes through the first recycling line,
wherein the temperature in an interior chamber in each of the plurality of vertical tubes is maintained by the coolant agent at a temperature of between about 232° K to 240° K,
wherein when the mixture of water, hydrogen gas and carbon dioxide freeze to form tube-ice in the interior of the plurality of vertical tubes, the tube-ice is released from the interior of the plurality of vertical tubes,
wherein the tube-ice is cut into distinct pieces of tube-ice by the cutter upon release from the interior of the plurality of vertical tubes,
wherein the cut tube-ice is introduced into an interior of the isolating lock chamber with carbon dioxide overpressure,
wherein excess hydrogen gas and carbon dioxide gas that exits the plurality of vertical tubes is recirculated to the eductor,
wherein the isolating lock chamber with carbon dioxide overpressure is isolated from external atmosphere by closure of the first guillotine damper at one end of the isolating lock chamber with carbon dioxide overpressure and the second guillotine damper at the opposing end of the isolating lock chamber with carbon dioxide overpressure,
wherein the isolating lock chamber with carbon dioxide overpressure is thereafter filled with carbon dioxide gas through the inlet port,
wherein thereafter the second guillotine damper is opened and the HRI is removed from the interior chamber of the isolating lock chamber with carbon dioxide overpressure.

2. The system of claim 1, wherein the temperature within the interior of each of the plurality of cooled vertical tubes forms carbon dioxide clathrate hydrate clusters from the mixture.

3. The system of claim 1, wherein the pressure within the interior of the cooled vertical tubes is around atmospheric.

4. The system of claim 1, wherein the coolant comprises anhydrous ammonia refrigerant or R22 refrigerant.

5. The system of claim 1, wherein the water comprises a coloring agent.

6. The system of claim 1, wherein the mixture comprises a relative ratio of around 1 gallon water, 8 scf of $CO_2$ and 32 scf of $H_2$.

* * * * *